US009010265B1

(12) United States Patent
Ratigan

(10) Patent No.: US 9,010,265 B1
(45) Date of Patent: Apr. 21, 2015

(54) MOORING LINE COVER AND METHOD

(71) Applicant: Edward Ratigan, Graham, NC (US)

(72) Inventor: Edward Ratigan, Graham, NC (US)

(73) Assignee: Fjord, Inc, Graham, NC (US)

( * ) Notice: Subject to any disclaimer, the term of this patent is extended or adjusted under 35 U.S.C. 154(b) by 264 days.

(21) Appl. No.: 13/655,655

(22) Filed: Oct. 19, 2012

(51) Int. Cl.
*B63B 21/00* (2006.01)
*B63B 21/20* (2006.01)

(52) U.S. Cl.
CPC ..... *B63B 21/20* (2013.01)

(58) Field of Classification Search
CPC ..... B63B 2021/203; B63B 21/20
USPC ..... 114/230.2, 230.26
See application file for complete search history.

(56) References Cited

U.S. PATENT DOCUMENTS 3,073,276 A * 1/1963 Taylor ..... 114/230.26
5,441,790 A * 8/1995 Ratigan ..... 428/100
8,502,069 B2 * 8/2013 Holland et al. ..... 174/36

* cited by examiner

*Primary Examiner* — Edwin Swinehart
(74) *Attorney, Agent, or Firm* — Blake P. Hurt

(57) ABSTRACT

A cover for a mooring line having a terminal eyelet, the cover having a sheath, with a pair of hook and loop strips positioned on opposite surfaces of the sheath. The cover is a single piece configured to enclose both a terminal eyelet and linear line section of a mooring line and also has a strap attached to the sheath proximate the linear line section to retain the sheath in position on the linear line section. A method for using the cover to protect mooring lines is also provided.

13 Claims, 2 Drawing Sheets

MOORING LINE COVER AND METHOD

FIELD OF THE INVENTION

The invention herein pertains to protective covers and particularly pertains to a protective cover for mooring lines used to secure nautical vessels and the like.

DESCRIPTION OF THE PRIOR ART AND OBJECTIVES OF THE INVENTION

Mooring lines are used to secure large machines such as yachts to support structures like docks or buoys. Mooring lines must be able to withstand large tensile loads, should be resilient, must not react chemically with water, and should have relatively long fatigue life despite repeated cycles of stress and relaxation. As used herein, the term "mooring line" is known in the art to encompass any line used in the marine field for the control of loads to which it is attached, for example in towing or the act of mooring a vessel to a dock. A mooring line typically includes two sections: a linear section that can stretch hundreds of feet (meters) in length, and a loop section that is sized to extend over a mooring post affixed to the dock, sometimes referred to as a bollard.

In addition to requiring sufficient tensile strength to secure a vessel, mooring lines also must withstand prolonged abrasive cycles that result from friction produced from a boat bobbing on the water surface. This friction causes wearing over time that can lead to the mooring line breaking during use, allowing a docked vessel to float away and become a hazard to itself and others. By reducing friction on the line, the structural integrity of the mooring line can be greatly prolonged and overall maritime safety can be increased. While various line covers have been used in the past, they have often been ineffective due to positioning problems of the two separate pieces whereby the linear line cover section slides away from the eyelet section cover, exposing the line to wear. Also, previous covers were difficult and time-consuming to install or remove.

Thus, in view of the problems and disadvantages associated with prior art line covers, the present invention was conceived and one of its objectives is to provide a mooring line cover that protects both loop and linear sections of a mooring line.

It is another objective of the present invention to provide an integrated, one-piece mooring line shroud.

It is still another objective of the present invention to provide a mooring line cover with a strap to secure the cover in place.

It is yet another objective of the present invention to provide a cover with a pair of hook and loop material sections for encasing a line therein.

It is a further objective of the present invention to provide an eyelet cover and linear line cover formed together in a unitary piece.

It is still a further objective of the present invention to provide a nylon line shroud with a spacing band to prevent the linear cover section from leaving line exposed.

It is yet a further objective of the present invention to provide a method for protecting line by encasing the line in a shroud and securing the line therein.

It is yet another objective to provide a method for protecting a mooring line by attaching a strap of hook material to the line surface.

It is still a further objective to provide a method of protecting line during use by affixing a spacing band around the shroud.

Various other objectives and advantages of the present invention will become apparent to those skilled in the art as a more detailed description is set forth below.

SUMMARY OF THE INVENTION

The aforesaid and other objectives are realized by providing a unitary mooring line shroud that encases both the eyelet and linear sections of a mooring line. The shroud includes opposing hook and loop sections along the linear and eyelet sections for encasing a mooring line therein. A strap of hook material is affixed to the end of the linear section proximate the eyelet section whereby when the cover is positioned on the line the strap can be wrapped around the eyelet portion of the mooring line and attached to the opposing side of the mooring line. Thereafter the hook and loop sections are engaged about the shroud providing structural integrity to the linear and eyelet sections of the cover. Spacing bands are provided proximate the joining point of the linear and eyelet cover sections and proximate the midpoint of the eyelet section for wrapping therearound for added integrity.

DETAILED DESCRIPTION OF THE PREFERRED EMBODIMENT AND OPERATION OF THE INVENTION

Figure 1:
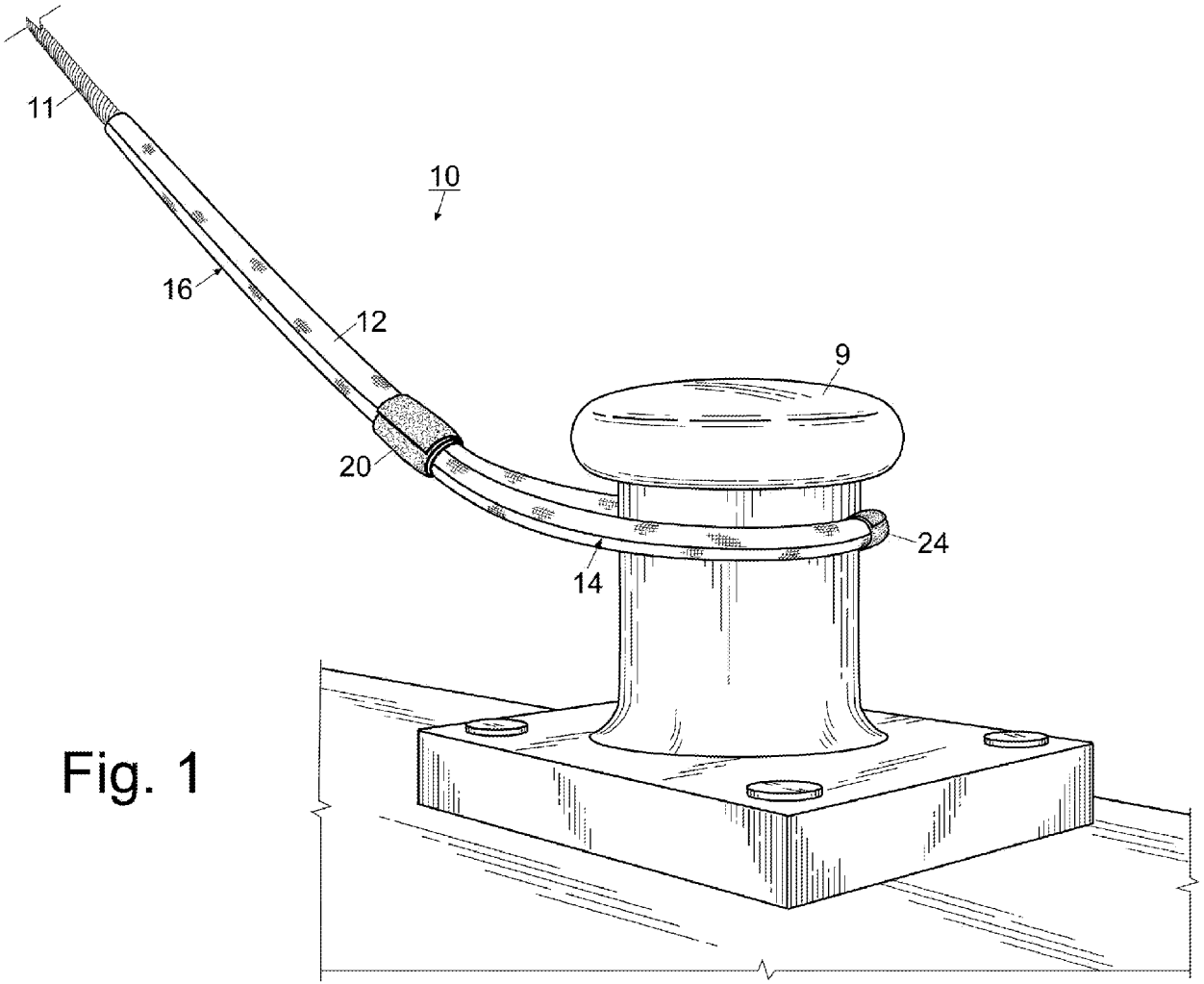
FIG. 1 shows a side perspective view of a protective line cover in place on a mooring line attached to a bollard.

For a better understanding of the invention and its operation, turning now to the drawings, FIG. 1 shows a side perspective view of line 11 encased in protective cover 10. Although line 11 is displayed as a mooring line in FIG. 1, protective cover 10 with eyelet section 14 and linear section 16 could be used for any line. Preferred protective cover 10 includes sheath 12 which is formed from a heavy duty woven nylon but other materials that simultaneously protect line 11 from abrasively rubbing on bollard 9 or other anchoring points such as posts or buoys could also be used. Sheath 12 includes linear section 16 and eyelet section 14 which are fastened together during manufacturing to form a one-piece construction. While several methods could be used to affix linear section 16 to eyelet section 14, preferred sheath 12 is sewn together as seen in FIG. 2 by stitching 30 to ensure structural stability.

FIG. 1 also demonstrates spacing bands 20 and 24. Band 20 is positioned at the junction of linear line section 16 and eyelet line section 14 and is designed to provide integrity to the junction point and prevent any separation of linear section 16 from eyelet section 14 that might expose a portion of line 11 which is undesirable. Spacing band 24 is located opposite band 20 with the purpose of preventing protective cover 10 from sliding to one side or the other. With bands 20 and 24 securely engaged by wrapping around sheath 12, protective cover 10 substantially reduces the amount and duration of damaging wear encountered by line 11 during use. Rectangular spacing bands 20 and 24 each preferably include a section each of hook and loop material respectively 22, 23 affixed thereto in opposing relation for engagement purposes. Preferred bands 20, 24 are formed from woven nylon to assist in protecting line 11 from friction damage and provide added durability to cover 10. Although hook and loop material is preferred, other fasteners such as buttons, snaps, and ties would also suffice.

Figure 2:
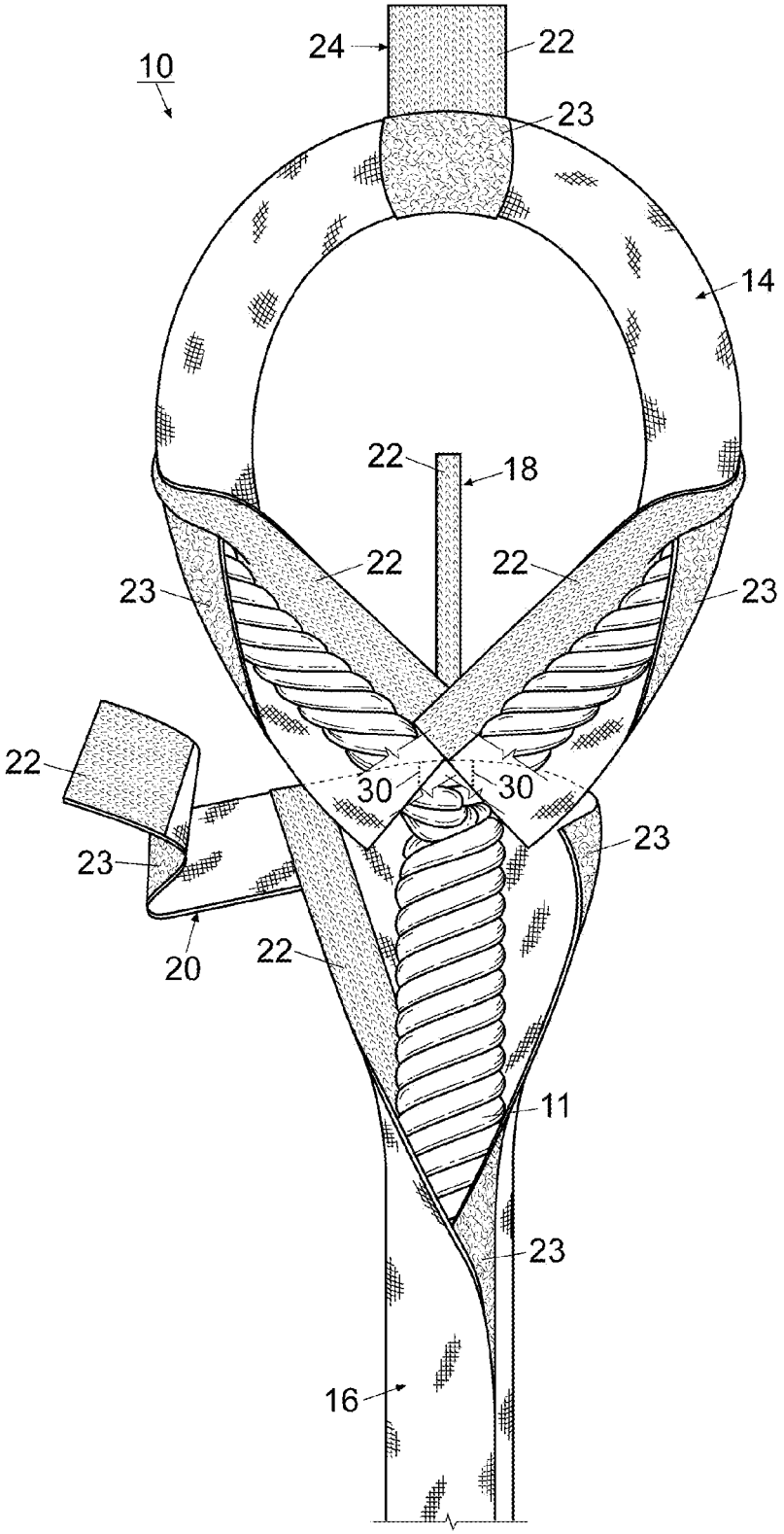
FIG. 2 pictures a top plan view of the line cover of FIG. 1 as removed from the bollard and in a partially open posture.

FIG. 2 pictures a top plan view of protective line cover 10 with spacing bands 20, 24 and portions of hook and loop sections 22, 23 disengaged or in an "open" position. FIG. 2 also illustrates strap 18 which is affixed to the back side of linear section 16 proximate the junction point with eyelet section 14. Strap 18 preferably includes hook section 22 for frictionally engaging line 11. Modern nautical lines are often formed from nylon or other polymeric materials that may become slick when wet. Therefore, it is desirable for strap 18 to engage line 11 to assist in maintaining linear section 16 of cover 10 in a proper protective position on mooring line 11. Such engagement also assists in deterring the separation of linear section 16 from eyelet section 14 over time during use.

Hook and loop sections 22, 23 are preferably strips that extend the longitudinal length of cover 10 but other shapes and configurations of hook and loop material are also anticipated. When in the open position, line 11 can be quickly inserted into protective cover 10 without any special tool, knowledge, or maritime skill. After line 11 is positioned therein, strap 18 is pulled through the eyelet portion of line 11 and affixed to the linear portion of line 11 to prevent the aforementioned displacement of protective cover 10. Once strap 18 has securely engaged line 11, hook and loop sections 22 and 23 of eyelet section 14 are folded over line 11 and engaged such that they form a tight connection around line 11. Spacing band 24 is then wrapped around cover 10 whereby hook section 22 is engaged with loop section 23 to further secure cover 10 to line 11. Hook and loop sections 22 and 23 of linear section 16 are then tightly engaged to secure strap 18 affixed to line 11 therein along with the ends of eyelet section 14 and form a tight connection around the linear section of line 11. Thereafter, spacing band 20 is wrapped around the junction point of eyelet section 14 and linear section 16 whereby hook section 22 is engaged with loop section 23 to further secure cover 10 to line 11. Bands 20 and 24 further assist in ensuring and maintaining the engagement of hook sections 22 with loop sections 23 of respectively linear section 16 and eyelet section 14.

A method for protecting maritime mooring line 11 with protective cover 10 comprises the steps of providing unitary cover 10 with sheath 12 having hook and loop sections 22, 23 positioned on opposing surfaces of both terminal eyelet section 14 and linear line section 16 to fully enclose mooring line 11 as seen in FIG. 1. The method also includes the step of providing strap 18 attached to sheath 12 near the junction point of linear section 16 and eyelet section 14 to wrap around and engage line 11 to assist in retaining sheath 12 on line 11. The method further includes the step of providing a first spacing band 20 adjacent the junction point of linear section 16 and eyelet section 14 to wrap around each and engage itself by respective hook and loop sections 22, 23 for added integrity to cover 10. The method further includes the steps of positioning line 11 within sheath 12, securing strap 18 to line 11, attaching hook and loop sections 22, 23 of both linear section 16 and eyelet section 14 to one another as seen in FIG. 2, and affixing first spacing band 20 about sheath 12. The method preferably further includes the steps of providing second spacing band 24 positioned on eyelet section 14 in opposing relation to first spacing band 20 and securing second spacing band 24 about sheath 12 to further secure the connection of hook and loop sections 22, 23.

As would be understood the materials used herein such as the woven nylon, hook and loop sections and stitching are heavy duty and waterproof for extended life and durability to withstand the heavy load bearing, water and weather conditions the cover is subjected to during use.

The illustrations and examples provided herein are for explanatory purposes and are not intended to limit the scope of the appended claims.

I claim:

1. A cover for a mooring line having a linear line section and a terminal eyelet, the cover comprising: a sheath formed from a woven material with a linear line section and an eyelet section, a pair of corresponding hook and loop strips, one of said corresponding hook and loop strips positioned at respective lateral edges of said sheath linear line section, said other corresponding hook and loop strips positioned at respective lateral edges of said sheath eyelet section, said sheath configured to enclose both said terminal eyelet and said linear line section, a strap, said strap attached to said sheath proximate said linear line section to retain said sheath on said linear line section.

2. The cover of claim 1 further comprising a spacing band, said spacing band affixed to said sheath.

3. The cover of claim 1 wherein said sheath is formed from nylon.

4. The cover of claim 1 wherein the sheath is integrally formed with an eyelet section and a linear line section.

5. A cover for a mooring line in combination with the line, the combination comprising:

a) a mooring line defining a terminal eyelet attached to a liner line; and b) a cover comprising a sheath, said sheath formed from a polymeric material with a linear line section and an eyelet section, said sheath comprising corresponding first and second hook and loop strips, said first corresponding hook and loop strips positioned at respective lateral edges of said sheath linear liner section, said second corresponding hook and loop strips positioned at respective lateral edges of said sheath eyelet section, said hook and loop strips positioned to engage while enclosing said mooring line within said sheath, a strap, said strap positioned at the intersection of said sheath eyelet and said linear line section to engage said mooring line therein.

6. The combination of claim 5 further comprising a first spacing band, said first spacing band affixed to said sheath.

7. The combination of claim 6 wherein said sheath is formed from nylon.

8. The combination of claim 7 wherein said nylon is woven.

9. The combination of claim 8 further comprising a second spacing band, said second spacing band attached to said sheath, said second spacing band positioned in opposing relation to said first spacing band.

10. A method for protecting a mooring line, said method comprising the steps of:

a) providing a protective cover for a mooring line comprising a sheath with a linear line section and an eyelet section and a pair of corresponding hook and loop sections, one of said corresponding hook and loop sections positioned at respective lateral edges of the sheath linear liner section, the other corresponding hook and loop sections positioned at respective lateral edges of the sheath eyelet section and configured to enclose both a terminal eyelet and linear line section of a mooring line, a strap attached to the sheath proximate the linear line section to retain the sheath on said linear line section, and a first spacing band affixed to the sheath;

b) positioning the mooring line within the sheath;

c) securing the strap to the mooring line;

d) attaching the respective hook and loop sections to one another; and e) affixing the first spacing band about the sheath.

11. The method of claim 10 wherein the step of providing a sheath further includes providing an integrated sheath configured to enclose the terminal eyelet and linear line section of the mooring line in one piece.

12. The method of claim 11 further comprising the step of providing a second spacing band positioned in opposing relation to the first spacing band.

13. The method of claim 12 including the step of securing the second spacing band about the sheath.

* * * * *